US005106275A

United States Patent [19]

Santi et al.

[11] Patent Number: 5,106,275

[45] Date of Patent: Apr. 21, 1992

[54] ARRANGEMENT ON A PUMP UNIT

[75] Inventors: Franco Santi; Giorgio Galavotti, both of Modena, Italy

[73] Assignee: Tetra Dev.-Co., Modena, Italy

[21] Appl. No.: 629,612

[22] Filed: Dec. 18, 1990

[30] Foreign Application Priority Data

Dec. 20, 1989 [IT] Italy ..... 22756 A/89

[51] Int. Cl.[5] ..... F04B 35/02; F15B 15/24

[52] U.S. Cl. ..... 417/403; 92/13.1; 417/274

[58] Field of Search ..... 417/403, 404, 274; 92/13.1, 13.4, 13.6, 60, 13, 13.3

[56] References Cited

U.S. PATENT DOCUMENTS

| | | | |
|---|---|---|---|
| Re. 25,873 | 10/1965 | Rutherford | 92/13.6 |
| 1,777,293 | 10/1930 | Curtis | 92/13.1 |
| 2,937,621 | 5/1960 | Herrmann | 91/280 |
| 3,685,554 | 8/1972 | Encke | 141/59 |
| 3,760,911 | 9/1973 | Porter | 92/13.4 |
| 3,793,925 | 2/1974 | Collin | 92/13.1 |
| 4,309,156 | 1/1982 | Gonner | 92/13.6 |
| 4,869,397 | 9/1989 | Corniea | 92/13.1 |
| 4,964,533 | 10/1990 | Allington | 417/17 |

FOREIGN PATENT DOCUMENTS

| | | |
|---|---|---|
| 1409184 | 9/1969 | France . |
| 2188906A | 11/1986 | United Kingdom . |

*Primary Examiner*—Richard A. Bertsch
*Assistant Examiner*—Peter Korytnyk
*Attorney, Agent, or Firm*—Burns, Doane, Swecker & Mathis

[57] ABSTRACT

Pump units comprising a metering reciprocating pump with adjustable length of stroke are used in packing machines for filling of packing containers with a metered quantity of flowable contents, e.g. yogurt. Adjustments in the length of stroke in order to adapt the amount of filling goods to the volume of the packing container interferes with the breaking sequence at the extreme position of the piston and alters the time for each pumping stroke. These drawbacks are avoided by means of an arrangement which includes a movable braking device for the piston as well as a valve arrangement which is linked to the braking device and serves to adapt the speed of the piston to the length of stroke.

15 Claims, 1 Drawing Sheet

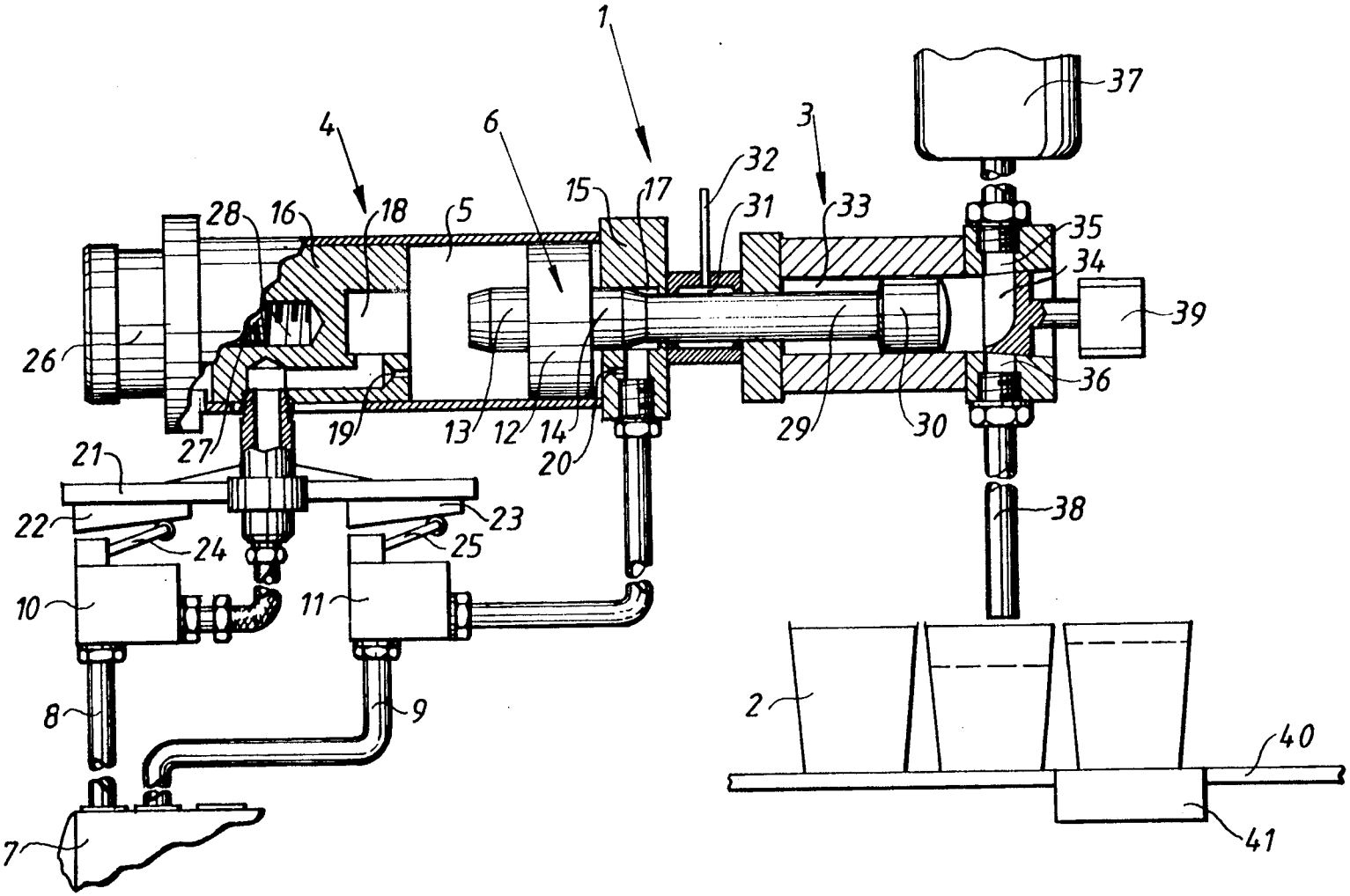
1
2
3
4
5
6
7
8
9
10
11
12
13
14
15
16
17
18
19
20
21
22
23
24
25
26
27
28
29
30
31
32
33
34
35
36
37
38
39
40
41

ARRANGEMENT ON A PUMP UNIT

The present invention relates to an arrangement on a pump unit having a metering reciprocating pump driven by a piston and cylinder unit of variable stroke.

Metering reciprocating pumps are used in a great number of different fields of application, such as in the filling of foodstuff into packing containers. Within this field of application, it is essential that the foodstuff, which may be yogurt, ice-cream, meat or fruit soups, is pumped and handled with the greatest possible caution so as to ensure that it retains its desired consistency and stays homogeneous. For example, it is undesirable that soups are not separated into a liquid portion and a particle portion. To achieve this, it is important that the pump and the ducts leading to and from the pump, respectively, are designed with as few sharp bends as possible and that the product is pumped at the lowest possible pressure and speed. Metering reciprocating pumps, which are used for the filling of individual packing containers passing on a conveyor, are designed so that the desired quantity of contents is delivered into each packing container during the whole of the space of time which is available. Moreover, at the start and finish of each pump stroke, a gentle braking of the piston must take place, so that pressure surges, which may detrimentally affect the consistency of the product, are avoided. When packing containers of different sizes are to be filled in the same packing machine, it is necessary to provide the reciprocating pump with an adjustable stroke volume. In practice, this is achieved by providing the reciprocating pump, which generally is driven hydraulically or pneumatically, with a mechanically adjustable stopping means. The stopping means can include a rod which can be screwed into the cylinder to a desired degree and against which the piston will make contact mechanically before it attains its actual stopping position. Control of the volume pumped at each stroke can be achieved in this way, but the piston follows an asymmetrical pattern of movement, since the presence of the mechanical stopping device prevents use of the braking device at the one end of the cylinder. The asymmetrical pumping action entails a risk of reduced pumping accuracy. The sudden mechanical contact of the piston against the stopping means causes knocks and impacts which are propagated in the form of pressure surges in the pumped foodstuff. The pressure surges negatively affect the consistency and homogeneity of the foodstuff.

The shortening of the piston stroke because of the mechanical stopping means also results in a shorter time for each pumping stroke. In the majority of cases, full use of the pumping stroke is not achieved, since the feed stroke for the packing container intended for filling is not variable depending on the size of the packing containers. The pressure variation in the contents and the speed of the contents through the pump and corresponding ducts consequently become unnecessarily great and undesirably effects the quality of the product.

It is an object of the present invention to provide an arrangement on a pumping unit which may vary the length of stroke of the pump with even and unaltered acceleration and retardation, respectively, so that the pump piston has a uniform pattern of acceleration and retardation regardless of the actual adjustment of the length of stroke.

It is a further object of the present invention to adapt the speed of the pump piston to the actual length of stroke, so that the same time is taken up for a working stroke independently of whether the pumped volume is great or small. As a result, optimum use can be made of the available filling time for each packing container.

Finally, it is a further object of the present invention to provide a simple and reliable arrangement on a pump unit which is not subject to the disadvantages of the known arrangements and which makes it possible to monitor and adjust the volume pumped automatically.

The abovementioned objects and other objects are been achieved in accordance with the present invention.

Preferred embodiments of the arrangement in accordance with the invention, moreover, have been given the characteristics evident from the specification and claims.

BRIEF DESCRIPTION OF THE DRAWINGS

A preferred embodiment of the arrangement in accordance with the invention will now be described in more detail with special reference to the attached, schematic drawing which depicts a preferred embodiment of the present invention.

DESCRIPTION

The arrangement in accordance with the present invention is used on a pump unit 1 which is used for the filling of prefabricated packing containers 2 with desired contents, e.g. yogurt. The pump unit 1 comprises a metering reciprocating pump for the delivery of contents in portions of the desired magnitude and a piston and cylinder unit 4 for the driving of the reciprocating pump 3. The piston and cylinder unit 4, which is connected directly with the reciprocating pump 3, is driven by a pressure fluid, preferably compressed air. The pump unit 1 may be mounted in, or constitute a part of, a packing machine for the manufacture, filling and closing of individual packing containers. Various designs of such packing machines for the manufacture of individual packing containers from weblike material or from more or less preformed blanks are known. These different types of packing machines need not be described in greater detail in the present context.

The piston and cylinder unit 4 in accordance with the invention has a cylinder 5 wherein a driving piston is movable to and fro by means of a pressure fluid. The pressure fluid, which preferably is compressed air, is supplied from a source of pressure fluid 7, e.g. a compressor-fed compressed air tank of known type, and is conducted in conventional manner via a directional or maneuvering valve (not shown) alternately to two ducts 8,9, which open into the cylinder 5 at opposite sides of the driving piston 6. The ducts 8,9 each have a flow control valve 10 and 11 respectively, whose function will be described in more detail below.

The driving piston 6 located in the cylinder 5 of the piston and cylinder unit 4 has a central head part 12 which, possibly with the help of piston rings or other known sealing devices, is in slidable contact with the inner wall of the cylinder 5. The piston 6 also includes two partly conical brake parts 13,14 projecting in opposite axial directions from the head part 12. The piston and cylinder unit 4 also has a fixed end wall 15 and a movable end wall serving as a braking device 16. The end wall 15 as well as the braking device or movable end wall 16 have brake cylinders 17,18 respectively, on the side facing towards the piston 6. Two ducts 8,9 open into the brake cylinders, respectively, for the pressure fluid. The brake cylinders have a diameter which substantially corresponds to, or slightly exceeds, the diameter of the brake parts 13, 14, respectively, of the piston 6 and may be provided, with suitable sealing rings of known type in contact with the brake portion. From the parts of the ducts 8,9 present in the end walls 15,16 extend branch ducts 19,20 provided with throttles to the cylinder 5 on both sides of the driving piston 6. The brake parts 13,14, the brake cylinders 17,18 and the branch ducts 19,20 together form a braking system which prevents abrupt stopping of the driving piston in the respective end position gently and brakes the driving piston according to a predetermined curve which is identical for both end positions. This will be described in more detail in the following in connection with the description of the functioning of the pump unit.

The movable end wall or braking device 16 supports a bridge 21 which is provided with two identical, adjustable cams 22,23. Against the cam surfaces of the cams lie two governor arms 24, 25 which are connected with the two valves 10,11 and are designed as adjustable choke valves. The setting of the governor arms 24,25 affects the passageway area in the two valves. and. More particularly, a movement of the bridge 21 to the right in the Figure means that the governor arms 24, 25 are acted upon downwards in the direction towards the respective valve causing the passageway area in the valves 10, 11 to be reduced in proportion to the movement of the bridge 21 to the right. Since the bridge 21 and the braking device 16 are rigidly connected with one another, the movement of the bridge 21 will correspond to the movement of the braking device 16. Furthermore, such movements is brought about by a stepping motor 26 which by way of a threaded rod 27 engages into a central base hole 28 threaded in corresponding manner into the braking device 16. By way of the stepping motor 26, the movable braking device 16 can be displaced to the desired position in the cylinder 5. In this manner, the free length of the cylinder 5 is varied so that the piston 6 obtains a desired length of stroke. The setting of the position of the braking device 16 can be done by manual operation of the stepping motor 26 or by means of a switch or the like. But, the stepping motor 26 also can be connected electrically to a central unit, not shown, which adjusts the position of the braking device 16 in relation to e.g. the measured quantity of contents in the packing container filled by means of the reciprocating pump 3.

One end of the driving piston is connected with a piston rod 29 in the reciprocating pump 3. The other end of this piston rod 29 is connected to a pump piston 30. To ensure a bacteriological separation between the piston and cylinder unit 4 and the reciprocating pump 3, the piston rod 29 passes a sterile barrier 31 provided with packings of a conventional type. Steam is supplied to it via a supply pipe 32. The pump piston 30 is movable to and fro in a pump cylinder 33. At the end, opposite to the piston rod, a cone valve 34 is located, which on turning, opens and closes alternately an inlet 35 and outlet 36 respectively. The inlet and outlet are situated diametrically opposite one another at the free end of the reciprocating pump. The inlet 35 is connected to a tank 37 for contents and the outlet 36 is connected, possibly via valves or other known devices not shown, to a filling pipe 38 via which contents deriving from the tank 37 can be proportioned out into the packing containers 2. The cone valve 34 is of a known type and is operated by means of an actuating device 39 which e.g. may be pneumatic or electrical.

The packing containers 2, which are to be filled with the desired quantity of contents, are advanced to the correct position underneath the outlet opening of the filling pipe 38 by means of a conveyor 40 which. After the filling, the conveyor may place the packing containers 2 onto scales 41 which, via a control unit, may be connected to the stepping motor 26 for the automatic regulation of the length of stroke of the pump as a function of the quantity of contents delivered.

When the pumping unit in accordance with the invention is used for foodstuffs, and especially on pumping a previously sterilized foodstuff, a large number of sterile barriers and other devices are required to ensure that sterility is maintained during operation. These devices are well known to those versed in the art and are not described, therefore, in the present context.

When an arrangement in accordance with the invention is used on a packing machine of known type to deliver contents in portions suitable for individual packing container blanks, the reciprocating pump 3 sucks the contents from the tank 37, which must be kept filled continuously, therefore, with the desired contents. The contents may include pumpable foodstuffs of varying viscosity and composition, e.g. yogurt, fruit or meat particles in liquid mixture, emulsions or the like. When the desired quantity of contents for each individual packing container is determined, the braking device 16 of the piston and cylinder unit 4 is adjusted by means of the stepping motor 26 into such a position that the length of stroke of the driving piston 6, and thus also of the pump piston 30, provides the desired portion. Adjustment of the position of the braking device 16 is done either by manual maneuvering of a switch for the current to the stepping motor 26 or, for example, with the help of a control unit which converts a desired set pumping volume to a corresponding actuation of the stepping motor 26 so that the braking device 16 obtains a position corresponding to the pumping volume.

After the packing machine has been started and a packing container blank 2 has been advanced to the correct position at the opening end of the filling pipe 38, the pumping unit 1 in accordance with the invention is started by alternately providing compressed air 7 to the ducts 8,9 with conventional maneuvering valves, not shown. The compressed air is conducted via the respective valve 10,11 to the cylinder 5 where it alternately flows to one or other side of the piston 6 via the respective brake cylinder 17,18 (and partly via the corresponding branch ducts 19,20). As a result, the piston 6 in known manner is acted upon so as to move to and fro in the whole of the space available in the cylinder 5. Since the driving piston 6 is connected rigidly with the piston rod 29 and the pump piston 30, the pump piston 30, will move over a corresponding length of stroke in the pump cylinder 23. The driving means 39 simultaneously turns the cone valve 34 half a turn forwards and backwards in rhythm with the working and return stroke of the pump piston 30. At the return stroke of the pump piston 30, the cone valve 34 has the position shown in the Figure, i.e. the inlet 35 is open and contents can be sucked from the tank 37 via the inlet 35 and into the cylinder 33. In the return position of the pump piston 30, the driving means 39 is activated to turn the cone valve 34 a half turn so that the inlet 35 is closed at the same time as the outlet 36 is opened. Consequently, during the working stroke of the pump piston 30, the quantity of contents sucked into the pump cylinder 33 is delivered via the outlet 36 to the filling pipe 38 and the packing container 2 which at this instant is located underneath it. When the pump piston 30 has completed its working stroke a packing container has thus been filled with the desired volume of contents and subsequently is moved on with the help of the conveyor 40 to the scales 41 where a check weighing is carried out. If the weighing shows that the quantity of contents which the packing container 2 contains does not agree with the desired quantity, the scales 41 give a signal via a control unit to the stepping motor 26 to adjust the position of the braking device 16 in the cylinder 5 in such a direction and to such a degree that subsequent strokes of the pump can be expected to give a corrected desired pump volume. If lower demands are made on the accuracy, this correction, of course, may also be done manually. For example, every hundreth packing container may be check-weighed and the position of the braking device 16 adjusted accordingly if necessary.

Irrespectively of whether the arrangement in accordance with the invention is used for the filling of individual, prefabricated packing container blanks or of packing container blanks in the form of a coherent, tubular packing material web which in a known manner is advanced around the filling pipe, it is desirable that during each delivery of contents, the maximum period available is made use of before the packing container blank is moved away from the filling position at the opening of the filling pipe. This is particularly important when pumping sensitive products which, at a high rate of flow or at great variations in pressure, lose their original consistency or homogeneity. If the quantity of contents delivered at each stroke of the pump is thus reduced due to the length of stroke being diminished, it is desirable, therefore, to reduce at the same time the speed of the pump piston 30, so that the time which is consumed in one working stroke is kept constant. This is achieved in accordance with the invention with the help of the bridge 21 which is rigidly connected with the braking device 16, which is, in turn, mounted on the end of the compressed air duct 8 connected to the braking device 16. On displacement of the braking device 16, and therewith the bridge 21, in the direction towards the right in the Figure with the intention of reducing the length of stroke of the piston 6, each of the two cams 22,23 will act upon its respective governor arm 24,25 so that the valves 10,11 are throttled. As a result, the passageway area for compressed air is reduced so that movements of the driving piston 6 become slower. Through suitable adaptation of the slope of the cams 22,23, a complete adjustment can be achieved, so that the reciprocating pump 3, always makes full use of the time available for the filling of each individual packing container regardless of the amount of contents pumped.

Since the length of stroke of the driving piston 6 is adjusted by displacement of the actual braking device 16 in the cylinder 5, the braking of the driving piston 6 is not otherwise effected. That is, the acceleration and retardation curves of the driving piston 6 remain unchanged and identical; the only thing that is affected is the length of the intervening time during which the driving piston 6 moves at constant speed. This space of time corresponds movement of the driving piston from the moment one brake part 13, 14 leaves the corresponding brake cylinder 17, 18 until the opposite brake part 13, 14 reaches the respective brake cylinder 17, 18. The braking, depends exclusively on the main ducts 8, 9 being put out of function such that the compressed air has to flow via the two branch ducts 19, 20, respectively which have a diameter appreciably smaller than the inside diameter of the main ducts 8, 9. The maintaining of the soft braking and acceleration movement of the driving piston 6, and thereby of the pump piston 30, contributes effectively to a gentle handling of the product since pressure surges and impacts in the product are avoided, regardless of the length of stroke which has been chosen for the occasion and regardless of subsequent adjustment of the length of stroke.

The arrangement in accordance with the invention thus makes possible the continuous variation of the pumped volume of contents in accordance with a predetermined pumping curve whose acceleration and retardation sections remain unchanged when the length of stroke of the pump piston is altered. At the same time, a variation of the length of stroke does not involve any variation of the time chosen for each stroke of the pump. Consequently optimum use is made of the filling time available for each individual packing container. The arrangement in accordance with the invention can be used on all types of packing machines, either for the filling of an individual product or for the filling of a combination of different product components into each individual packing container. The volume pumped can be set manually, and the accuracy of volume can be monitored subsequently either by manual adjustment or automatically with the help of a control system which operates with actual and set values.

We claim:

1. An arrangement on a pump unit comprising a metering reciprocating pump and a piston and cylinder unit with controllable length of stroke driving it, said piston and cylinder unit having an axially movable braking device for adjusting a length of said stroke over a predetermined range, said braking device including means for maintaining a substantially constant period for performing a stoke over substantially said predetermined range of adjustment of said stroke length.

2. An arrangement in accordance with claim 1, wherein the braking device constitutes a part of the end wall of the cylinder.

3. An arrangement in accordance with claim 1, wherein the piston and cylinder unit are connected with a source of pressure fluid via a controllable valve which is linked to the braking device (16) so that a movement of the latter brings about a variation of the area of passage of the valve.

4. An arrangement in accordance with claim 3, wherein said means for maintaining a substantially constant period for performing a stroke comprises a cam against which lies a governor arm for the valve.

5. An arrangement in accordance with claim 3, wherein the braking device is connected mechanically with the valve.

6. An arrangement in accordance with claim 5, wherein means for maintaining a substantially constant period for performing a stroke comprises a cam against which lies a governor arm for the valve.

7. An arrangement in accordance with claim 1, wherein the braking device is movable by means of a stepping motor which is controlled as a function of the quantity delivered at each stroke of the pump.

8. An arrangement in accordance with claim 1, wherein said means for maintaining a substantially constant period for performing a stroke includes means for controlling a driving fluid of the piston and cylinder unit.

9. An arrangement in accordance with claim 1, wherein the piston and cylinder unit is pneumatic.

10. Pump apparatus comprising:

reciprocating pump means for filling containers with pumpable foodstuffs, said pump means including piston means having an actuating portion axially aligned with a pumping portion, said piston means being housed in cylinder means, said actuating portion being housed in an actuating chamber of said cylinder;

means for adjusting the stroke length of said piston means while maintaining a substantially constant period of time for performing a stroke; and, said means for adjusting including an adjustable chamber wall positioned at one end of said actuating chamber, said adjustable chamber wall being axially movable within said cylinder so as to vary the actuating chamber volume and thereby vary said stroke length of said piston means.

11. Pump apparatus in accordance with claim 10, further comprising valve means for supplying actuating fluid to said actuating chamber in a manner so as to impart reciprocating motion to said piston means, said valve means being adjustable according to movement of said adjustable chamber wall so as to vary a fluid flow through said valve means and thereby vary an actuating speed of said piston means.

12. Pump apparatus in accordance with claim 10, wherein said adjustable chamber wall and an opposing chamber wall of said actuating chamber include means for braking said piston means.

13. Pump apparatus in accordance with claim 11, wherein said valve means is mechanically linked to said adjustable chamber wall by a cam, said cam varying a passageway area of said valve means during movement of said adjustable chamber wall.

14. Pump apparatus in accordance with claim 11, further comprising means for controlling said adjustable chamber wall according to a measured quantity of foodstuff pumped by said piston means in one stroke.

15. Pump apparatus in accordance with claim 14, wherein said means for controlling includes a stepping motor for moving said adjustable chamber wall.

* * * * *